United States Patent [19]

Marechal

[11] 4,140,358

[45] Feb. 20, 1979

[54] LOAD CONNECTORS

[75] Inventor: Gilles Marechal, Paris, France

[73] Assignee: Société d'Exploitation des Procédés Marechal S.E.P.M., Paris, France

[21] Appl. No.: 813,052

[22] Filed: Jul. 5, 1977

[30] Foreign Application Priority Data

Jul. 9, 1976 [FR] France ..... 76 21145

[51] Int. Cl.[2] ..... H01R 13/44

[52] U.S. Cl. ..... 339/40; 339/64 M; 339/76

[58] Field of Search ..... 339/40, 41, 42, 64 R, 339/64 M, 76, 77, 79, 89 R

[56] References Cited

U.S. PATENT DOCUMENTS 3,853,376 12/1974 Marechal ..... 339/41

*Primary Examiner*—Roy Lake
*Assistant Examiner*—DeWalden W. Jones
*Attorney, Agent, or Firm*—Edwin E. Greigg

[57] ABSTRACT

Electrical connectors comprising complementally formed plug and socket elements each of which include safety disks to conceal the contacts the plug and socket elements further having pilot contacts and power contacts as well as mating means arranged to delay the separation of the power contacts and interlock means for the respective elements capable of temporarily immobilizing the plug and power socket elements to provide a power cut-off for electrical engagement of said elements.

11 Claims, 10 Drawing Figures

1
2
4
3
1

23a
17a
26a
15a
28a
8a
13a
19
6a
33a
29a
16a
24a
9a
25a
27a
12a
5a
14a
34a
30a
10
4

11
23b
30b
15b
28b
6b
26b
33b
13b
9b
16b
24b
29b
5b
12b
27b
25b
34b
7b
14b
8b

LOAD CONNECTORS

BACKGROUND OF THE INVENTION

The present invention relates to a connection device or connector and, more specifically to a load connector equipped with an upstream cut-off device controlled by pilot signal contacts.

Certain industrial connectors are designed to electrically connect a charged device or machine with a supply source. This is the case, for example, of connections or connectors for charging a storage battery for vehicles or electrical devices. A connector of this type comprises two parts - the socket and the male plug. In the case of the above-described use these two parts obviously each comprise charged contact elements since one part is connected to the supply source and the other to the charged device such as batteries. Moreover, without the simultaneous connection of the plug and socket to a current source it may happen that they each perform interchangeable roles and are alternately or arbitrarily connected to a current source.

It is known to protect the female contacts of a socket of an industrial connector from accidental contact by means of a safety disk which covers the contacts in the rest state and uncovers them by means of a special movement prior to insertion of the corresponding male part.

OBJECT AND SUMMARY OF THE INVENTION

One of the objects of the present invention is to provide a charging connector in which both the socket and the plug are protected from possible contact by means of two safety disks.

This protection must also be automatic, i,e., it must not necessitate an auxiliary or supplementary operation which, if it were omitted, would result in the breakdown of the safety system. It is a further object of the invention to provide a device wherein protection is automatically ensured by essential disconnection operations. Accordingly, the invention relates to an electrical connector comprising a socket and plug equipped with contact elements and designe to be electrically connected together. This connector is characterized in that the socket and plug are each equipped with a safety disk comprising a corresponding number of openings and disposed in a relative position corresponding essentially to the contacts with which it is provided. Means are provided for temporarily locking each of these disks in the rest state in an angular position in which it conceals the corresponding contacts and special means and operations for inserting the plug in the socket enable the disks to be unlocked, the contacts to be moved relative to their respective disk so as to align the contacts of the socket and plug and the corresponding openings in the disks, and finally an electrical connection to be ensured between the contacts and the plug and socket retained in this position. Disconnection is achieved by reversing these operations, thereby returning the elements to their starting position.

Above a specific current intensity construction standards necessitate the mounting of an upstream cutoff device which is mechanically or electrically controlled in such a way that contacts are connected during an interruption in the supply and the contacts are separated after disconnections of the supply to avoid the formation of an electric arc.

In devices equipped with an electrically controlled cut-off device, the latter generally comprises a press switch which is electrically connected to the cut-off device or of at least one pilot signal contact. In the latter case, the pilot contact or contacts are disposed in such a way that when the plug is being inserted in the socket, the contacts are engaged in the following order: ground, phases, pilot signal contacts. As a result, the latter close the cut-off device after connection of the ground and phases. Conversely, during the unplugging operation the contacts are disengaged in the following order: pilot signal contacts, phases and ground —thereby cutting off the supply load before the power contacts are separated.

In the case of the conventional plug-socket connectors the unplugging operation is generally effected by manual pulling and the time separating the disconnection of the pilot signal contacts and the phase and ground contacts is directly associated with the rapidity of the movement. In addition, the operating time of the cut-off device can be very short and is sometimes insufficient. As a result, the phase contacts may be disconnected before the upstream connection is effected. It is therefore necessary to increase the time between the separation of the pilot signal contacts and the phase contacts, for example, by means of an additional essential operation.

Another object of the invention is to provide a connector equipped with an upstream cut-off device controlled by at least one pilot contact, characterized in that the plug and the socket are equipped with mating means disposed in such a way as to delay the separation of the power contacts, after separation of the pilot contacts to ensure that the cut-off device has sufficient operating time. Moreover, the cut-off device or pilot contact control system may develop a malfunction. For this reason, it is another object of the invention to provide means for enabling the plug to attain a given rest position in which all the contacts are disengaged.

To achieve this object it is proposed according to the invention to provide the plug and socket with means, for example, interlocking means (bayonet means) which are disposed in such a way that the plug and socket are temporarily immobilized relative to one another in a position in which a connection is not established; the power contacts being sufficiently far away from one another that during unplugging this position provides a cut-fff position for the power contacts even if the upstream cut-of device has not operated.

A device such as the latter can obviously be equipped with safety disks according to the invention to provide a device offering considerable safety of operation. However, it is also apparent that the safety disks according to the invention can be used with any other current connecting device or connector which does not comprise a pilot contact system.

BRIEF DESCRIPTION OF THE DRAWING

Other objects, features and advantages of the present invention will be made apparent in the course of the following description thereof which is provided with reference to the accompanying drawings, in which.

DETAILED DESCRIPTION OF THE PREFERRED EMBODIMENT

Figures 1, 2, 3:
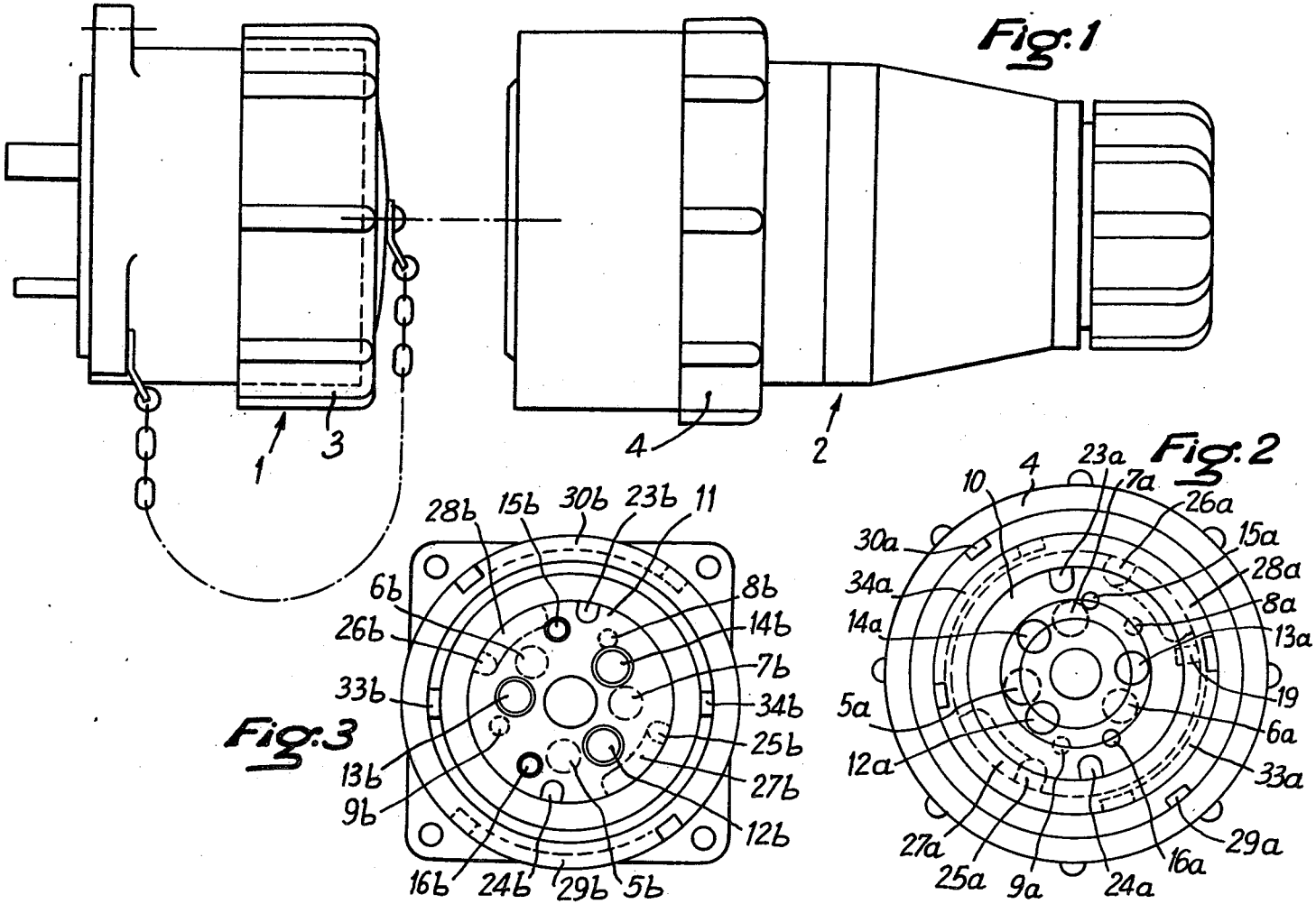
FIG. 1 is a diagrammatic plan view of a socket and plug according to the invention.
FIG. 2 shows an end view of the plug according to FIG. 1.
FIG. 3 shows an end view of the socket according to FIG. 1.

Turning now to the drawings, FIG. 1 shows a load connector equipped with a cut-off device 36 (shown in FIG. 8) which is disposed upstream and which is controlled by a pilot wire system. This connector consists of a socket 1 and a plug 2 designed to be inserted in the socket 1. The latter is equipped with a protective cover 3 and the plug is provided with a ring 4, the mode of operation of which will be described hereinafter. The socket and plug are equipped with conventional terminal pressure contacts and hereinafter are claimed as cooperative elements.

FIG. 2 shows an end view of the plug. The latter is provided with a number of pins 5*a*, 6*a* and 7*a* for the ground and phases and 8*a* and 9*a* for the pilot contacts (the pins are concealed and represented by perforated lines in the drawing). The socket (FIG. 3) is provided with corresponding contacts 5*b*–9*b*. Two safety disks 10 and 11 are mounted on the plug and socket, respectively. The disks 10 and 11 comprise openings 12*a*–16*a* and 12*b*–16*b* which are disposed essentially in the same manner as the pins 5*a*–9*a* and the contacts 5*b*–9*b*. The disks 10 and 11 are in an angular position such that the pins of the plug and the contacts of the socket are hidden.

Figure 4:
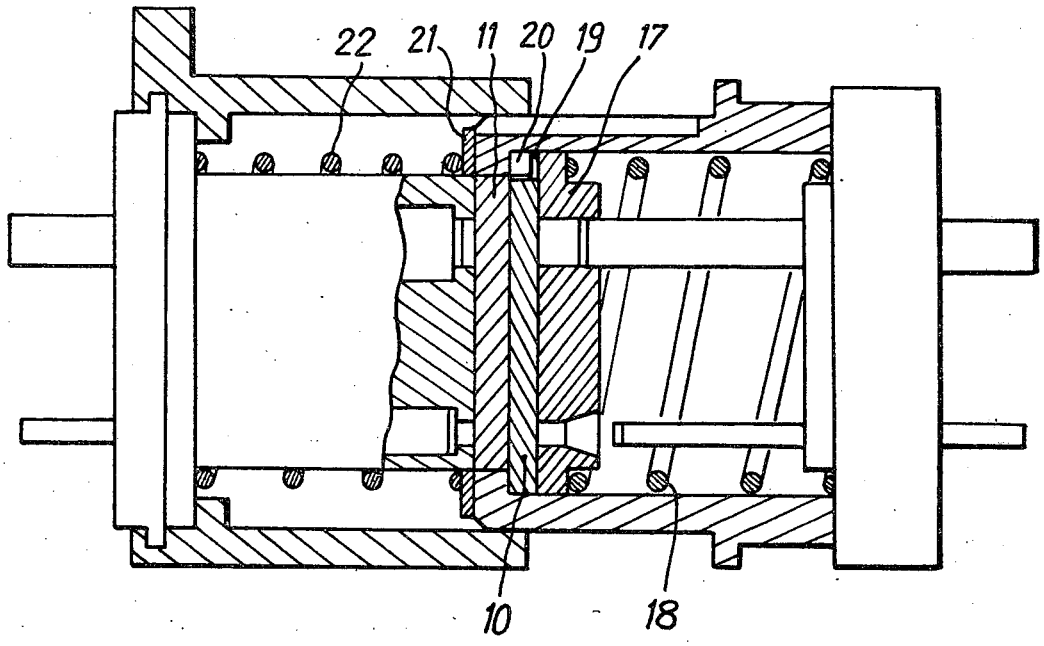
FIG. 4 is a partial longitudinal section of the plug and socket after the first insertion stage.

The first connecting operation consists in inserting the plug 2 in the socket 3 until the disks 10 and 11 are in contact with one another. This position is shown in FIG. 4. The plug and socket are angularly positioned with respect to one another by means, for example, of an interlock system (bayonet system) comprising lugs 33*b* and 34*b* of the socket and grooves 33*a* and 34*b* of the plug (FIGS. 2 and 3), such that the openings 12*a*–16*a* of the disk 10 and the corresponding openings 12*b*–16*b* of the disk are disposed opposite one another.

The section of FIG. 4 is such that two pins and two socket contacts are represented. The pins of the plug are integral in rotation with a disk 17 which is pushed against the disk 10 by a flexible means such as a spring 18. The disk 17 is equipped with openings for the free passage of the pins. In addition, the disk 10 is locked in position by means of a notch 19 (FIGS. 2 and 4) in which a lug 20 of the plug is adapted to lodge and the disk 11 is locked in position by means of a washer 21 which cooperates, in a conventional manner by means of notches and lugs, with the disk 11. The washer 21 is urged into its locking position by a spring means 22. The leading end of the plug is moved into the position shown until it contacts the washer 21. The disks 10 and 11 are also equipped with openings 23*a* and 24*a* (FIG. 2) and mating lugs 23*b*, 24*b* (FIG. 3) which are designed to cooperate with one another and render the disks integral in rotation.

It is thus considered now to be apparent that in this position the disks 10 and 11 are locked in place and are thus united for rotation and furthermore, that their respective openings are disposed opposite one another. However, the locking means described above can obviously be varied in different ways. For example, to provide increased security, the locking device of the disk 10 may be replaced or another lug provided which is mounted in the disk 17 and caused by spring pressure to lodge in a corresponding opening provided in the disk 10; a mating lug or lugs mounted on and provided on the disk 11 being designed to push back and flatten the lug or lugs on the disk 17 by passing through the disk 10 when the two disks are applied one against the other. The lugs of the disk 11 and the openings in the disk 10 then preferably replace the means 23*a*, 24*a*, 23*b*, 24*b* thereby rendering the disks united for rotation.

The following operation is a slight translational movement of the plug in the socket, for example, of 5 mm. This operation, which is not shown in greater detail, makes it possible to unlock the disks 10 and 11. Indeed, the lug 20 of the plug has been advanced with the latter and it frees the opening 19 of the disk 10 which abuts against the disk 11; the spring 18 thus being slightly compressed. Similarly, the disk 11 is unlocked by pressing the leading edge of the plug, causing a slight withdrawal of the locking washer 21, against the withdrawal spring means 22. In the case of the locking system of disk 10 which is described as a variant, it is obvious that contact between the disks 10 and 11 suffices to unlock the same.

The trailing face of the disk 10 is equipped with two lugs 25*a* and 26*a* which are disposed diametrically opposite one another and which are represented by the perforated line in FIG. 2. Similarly, the rear face of the disk 11 is equipped with two lugs 25*b* and 26*b* (FIG. 3). The disk 17 and the isolating body of the socket are equipped with circular grooves 27*a*, 28*a* and 27*b*, 28*b* (FIGS. 2 and 3) designed to cooperate in rotation with the lugs 25*a*, 26*a* and 25*b*, 26*b*, respectively. For practical reasons, more specifically, as a result of the number and diameters of the contacts and openings in the safety disks, the contacts and openings are angularly offset with respect to one another in the rest position by an angle of 40°, both in the case of the plug and the socket. Similarly, the grooves 27*a*, 28*a* and 27*b*, 28*b* comprise an angular opening of 40°.

From the angular position represented in FIGS. 2 and 3 and after releasing the safety disk, the plug is rotated so as to align its pins 5*a*–9*a* with the corresponding openings 12*a*–16*a*, i.e., about 40° in the positive trigonometric sense when considering FIG. 2. This movement is guided by the bayonet type interlock system 33*a*, 34*a* and 33*b*, 34*b*. The power pins or phases rotate the disk 17. At the beginning of this rotation the grooves 27*a* and 28*a* of the disk 17 are in the position shown in FIG. 2 with respect to the lugs 25*a* and 26*a*, whereas at the end of this rotation these grooves are able to draw the lugs in this direction.

In this position obtained after this rotation it is obvious that the pins of the plug and the openings in the two safety disks are aligned.

If the above-mentioned rotation is continued by a further 40°, the grooves 27*a* and 28*a* of the disk 17 rotate the lugs 25*a* and 26*a* and thus the disks 10 and 11, which are integral in rotation. At the end of this second rotation or, more specifically, after a rotation of 80°, the disk 11 has rotated about 40° in the reverse trigonometric direction when considering FIG. 3 and the openings 12*b*–16*b* are opposite the contacts 5*b*–9*b*. The lugs 25*b* and 26*b* are then in abutment in the corresponding grooves 27*b* and 28*b* of the socket in an outer position which is the reverse of that shown in FIG. 3.

Figure 7A:
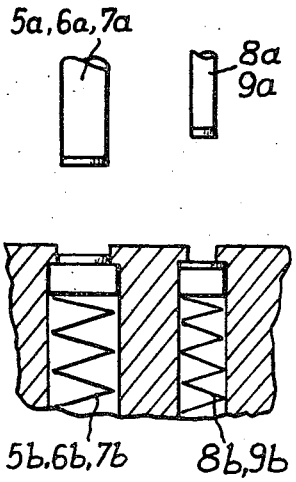
FIGS. 7*a, b* and *c* are diagrammatic views of a part of the contacts with the contacts in the disconnected position with the power contacts closed and with the pilot contacts disconnected and with all the contacts closed.

In this position the pins, contacts and openings in the disks are aligned. This position is a rest position of the plug where all the contacts are disconnected and corresponds to the position of the contacts in FIG. 7*a*. During unplugging this is a disconnection position of the power contacts even if the pilot circuit did not operate.

Figure 7B:
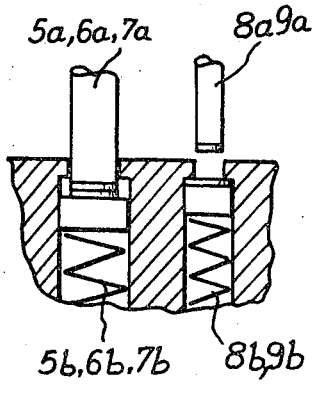
Figure 7C:
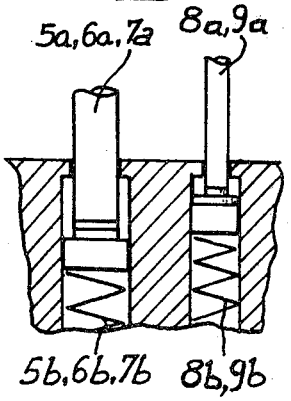
Figure 5:
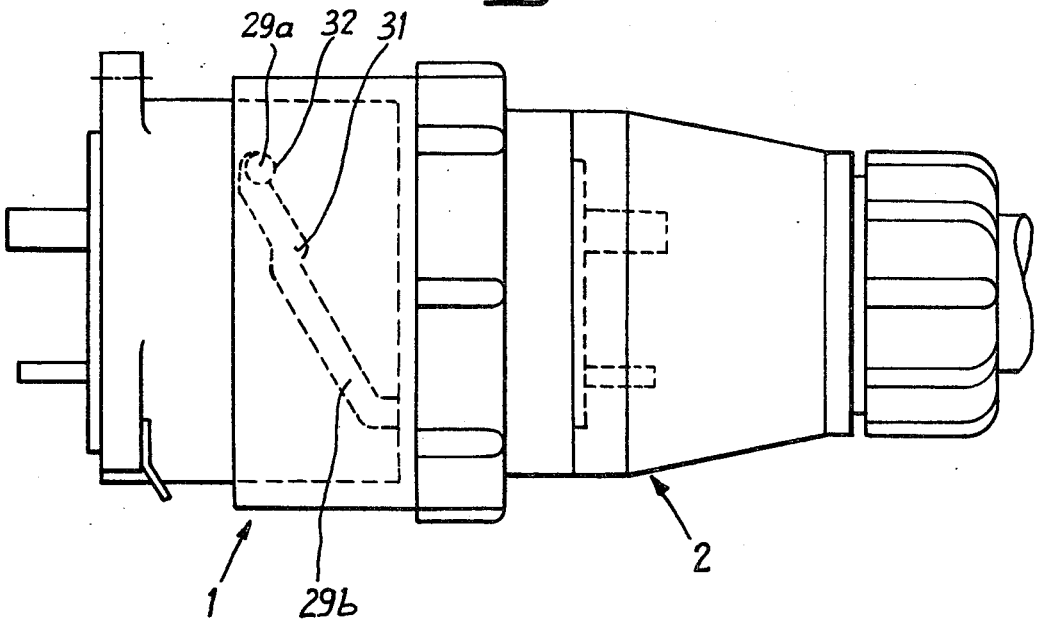
FIG. 5 is a plan view of the plug and socket in the engaged position.
Figure 6:
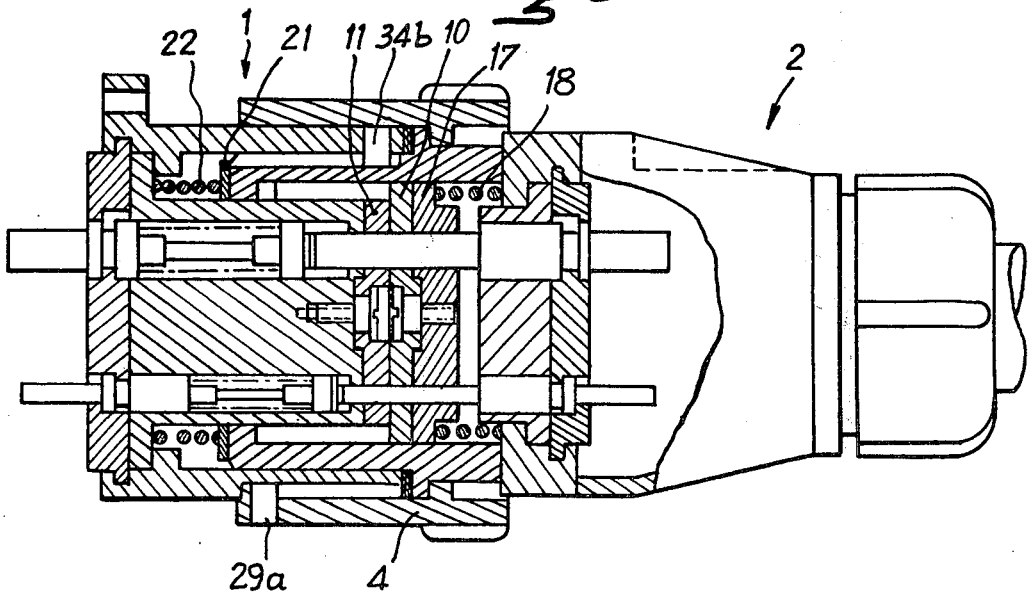
FIG. 6 is a partial section of the plug and socket in the position shown in FIG. 5.
Figure 8:
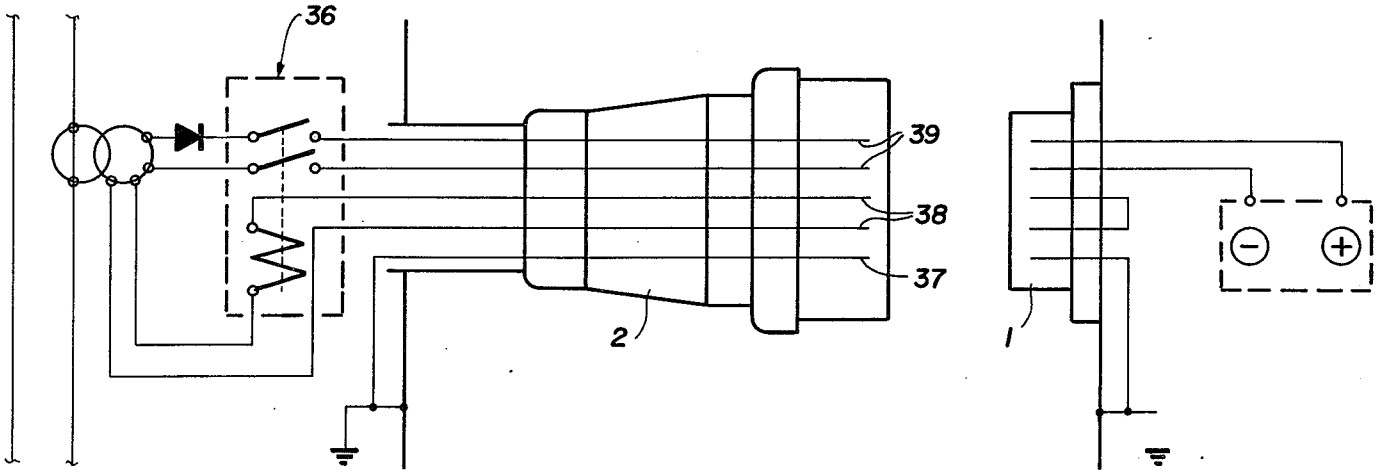
FIG. 8 is a schematic diagram showing the socket and plug of the invention incorporated in a battery charging system.

The final operation consists in moving the plug in the socket to obtain the connection of the contacts in the following order: ground 37, phases 39 and pilots 38 as shown in FIG. 8; the various contacts possessing relative longitudinal positions suitable for this purpose. To effect this latter movement the invention provides a rotating ring 4 which is disposed on the plug. This ring comprises two lugs 29*a* and 30*a* (FIG. 2) designed to cooperate with two inclines 29*b* and 30*b* (FIG. 3) provided in the socket. The latter possess the form shown in FIG. 5. After inserting the lugs 29*a* and 30*a* in the corresponding ends of the inclines, a suitable rotation of the ring 4 produces a translational movement of the plug in the socket until the lugs are lodged in the notches such as the notch 31 (FIG. 5) corresponding to the position of the contacts in FIG. 7*b*, i.e., the closed power contacts and open pilot contacts. This rotation of the ring 4 is continued until reaching the gripping position corresponding to the notch 32 shown in FIG. 5 and also in FIGS. 6 and 7*c*. During unplugging the reverse operations are carried out and the elements returned to their starting position.

The intermediate position obtained by means of the notch is especially important during unplugging. Indeed, rotation of the ring in the unplugging direction, causing a separating translational movement, is momentarily arrested or slowed down in the position shown in FIG. 7*b*. The pilot contacts are disconnected at this time. Separation of the power contacts is only effected after a specific period of time which enables the cut-off device disposed upstream to operate.

The above-mentioned intermediate position can be obtained in numerous ways, the object being to delay separation of the power contacts after separation of the pilot contacts. This delay can be obtained, for example, by mating means which are provided in such a way that the disconnection, on the one hand, of the pilot contacts and, on the other hand, of the power contacts, is achieved in the course of two different relativel movements of the plug and socket, each requiring a special manipulation, for example, a translational movement and a rotational movement produced by means of an interlock bayonet system or the like. In addition, the shape of the inclines may be completely different. Indeed, from the engaged position the inclines may comprise a first slope corresponding to the first translational movement and then a zero slope or gentler slope or even a slight reverse slope designed to arrest or slow down or reverse the translational movement, and then once again a slightly different slope, preferably similar to the first slope corresponding to the translational movement disengaging the power contacts.

It is obvious that numerous modifications can be employed without departing from the scope of the invention. More specifically, each time lugs and mating openings or guide inclines are mentioned, these may obviously be arbitrarily disposed on each of the cooperating parts or may even be replaced by corresponding means. Similarly, the ring 4 could be provided on the socket and not on the plug. In addition, if pressure type and contacts are preferable for the cut-off devices, other pin-type contacts and sockets, for example, could be used.

Moreover, the embodiment represented shows a junction or load connector equipped with an upstream cut-off device offering considerable reliability of operation and safety as a result of the safety disks. However, it is obvious that this device need only be equipped with one disk or may be used without a safety disk and also that the safety disks may be used in the case of all connectors in which the plug and socket are connected to a current source or in which the plug and socket are alternately or arbitrarily connected to a current source. This latter frequently applies to certain railroad connections.

What is claimed is:

1. An electrical connector comprising first and second cooperative elements having a socket and a plug provided with contact elements designed to be electrically connected together, further characterized in that the socket and the plug each comprise a safety disk equipped with a corresponding number of openings disposed in a complemental position relative to said contacts with which it is equipped, means provided for temporarily locking said disks in the rest position further means for plugging said plug into said socket so as to unlock said disks, to produce a relative movement of the contacts with respect to their respective disks so as to align the contacts of said cooperative elements and the corresponding openings in the disks and finally to ensure the electrical connection of the contacts and retention of said cooperative elements in this position, unplugging being accomplished by reverse movements which return the elements to their initial position.

2. An electrical connector as claimed in claim 1, in which said cooperative elements are provided with mating means so that upon a relative translational movement of the plug towards the socket guided by said means, said cooperative elements are disposed in a relative angular position in which the corresponding respective openings in each of the disks of the latter are disposed opposite one another, said disks being further provided with complemental mating means to render them integral in rotation as soon as they are applied one against the other.

3. An electrical connector as claimed in claim 2, in which one of said cooperative elements is locked by means of a washer equipped with means for securing it in rotation which are further mated with means provided on the disk and drawn into a locking position by a flexible means, with another of said cooperative elements provided thereon and on said last named element, said element further being disposed to engaged with the locking washer of the socket disk at the instant when the disks are applied one against the other, said last named element further including pins which rotate with a disk which is moved by a flexible means towards the disk of said last named element, said plug being provided with openings whereupon a translational movement of the plug towards the socket causes a withdrawal movement of the safety washer in opposition to its flexible displacement means said thereby freeing its blocking means and releasing the locking means of said last named element disk.

4. An electrical connector as claimed in claim 3, in which said disk of said other element is locked by mating means provided thereon by at least one lug on said disk integral in rotation with said pins and caused by a flexible means to become lodged in a corresponding opening provided in said other element and first cooperative element a mating mounted on said disk of said for the purpose of pushing back said last named means, said disk integral in rotation with the pins by passing through said disk of said other cooperative elements when said disks are applied one against the other.

5. An electrical connector as claimed in claim 3 in which said disk united for rotation with the pins of said other element comprises at least one groove or at least one lug designed to cooperate respectively with a lug or groove provided on said disk of said other element, the position of said groove being such that a rotation of said other element thus of the pins, enables, firstly by a relative rotational movement of the pins with respect to the safety disk of the plug, to locate the same opposite the corresponding openings in said disk and then to displace as a result of the cooperation of the lug and the groove, the two disks integral in rotation until the contacts of said first cooperative element are aligned with the corresponding openings of its disk, the latter preferably being provided with means mating with the means provided on said first cooperative elements in such a way as to limit the rotation of the disk with respect to said first element.

6. An electrical connector as claimed in claim 5, in which said pins and openings in said disk of said second element and that of the contacts said first element and openings in the disk provided thereon are complimental to one another and staggered by 40°.

7. An interlock system for comprising first and second cooperative elements electrical connectors provided with contact elements and arranged to be electrically connected together, and further including a cut-off device which is disposed upstream of one of said elements and controlled by at least one pilot contact, the various contacts being disposed to attain the following connection order during the pluggingin operation: possible ground, power or phases and pilot contacts and, during unplugging operation, the opposite disconnection order, said connector being characterized in that said first and second elements are provided with mating means disposed so as to delay the separation of the power contacts after separation of the pilot contacts thereby providing sufficient operating time for the cut-off.

8. An electrical connector as claimed in claim 7, in which disconnection of said guide contacts and said power contacts, is produced during two different relative movements of first and second elements each element requiring a special manipulating movement including a translational movement and a rotational movement obtained by means of said interlock system.

9. An electrical connector as claimed in claim 8, in which a mating means includes a rotating ring positioned about either of said elements and integral in translation with respect to the same, said mating means enabling in the unplugging operation a continuous rotating movement of said ring which firstly produces a relative translational separating movement of said first and second elements until the pilot contacts are disconnected without disconnecting the power contacts and then an arresting or slowing down or slight reverse translational movement and then, once again, a separating translational movement until the power contacts are disconnected.

10. An electrical connector as claimed in claim 9, in which said mating means of said ring on either of said cooperative elements comprise at least one lug and guide incline which are complementally formed on the longitudinal axis of said connector in such a way that during unplugging the rotation of said ring produces a translational separating movement of said cooperative elements, said incline comprising a first slope corresponding to the first translational movement, and then a zero slope to impede said translational movement, and then again a slope change which is preferably similar to the first slope corresponding to the disconnecting translational movement of the power contacts.

11. A connector as claimed in one of claims 7, in which said cooperative elements comprise interlock means, which are disposed in such a way that said cooperative elements are temporarily immobilized relative to one another in a position in which a connection is not provided, the power contacts being sufficiently far apart from one another that during unplugging this position provides a disconnection position of the power contacts even if the upstream cut-off device has not operated.

* * * * *